US005568014A

United States Patent [19]

Aoki et al.

[11] Patent Number: 5,568,014

[45] Date of Patent: Oct. 22, 1996

[54] TRAVELING-WAVE TUBE AMPLIFIER HAVING COLLECTOR POTENTIAL LOWER THAN BODY POTENTIAL

[75] Inventors: Yasuhiro Aoki, Yokohama; Kiyoshi Momota, Tochigi-ken; Tetsuo Yamamoto, Machida; Hideki Ide; Hiroshi Onihashi, both of Ootawara, all of Japan

[73] Assignee: Kabushiki Kaisha Toshiba, Kawasaki, Japan

[21] Appl. No.: 162,887

[22] Filed: Dec. 8, 1993

[30] Foreign Application Priority Data

Dec. 9, 1992 [JP] Japan ..... 4-351496
Sep. 10, 1993 [JP] Japan ..... 5-248459

[51] Int. Cl.[6] ..... H01J 25/34

[52] U.S. Cl. ..... 315/3.5; 315/5.38; 330/43

[58] Field of Search ..... 315/3, 5.38, 3.5; 330/43

[56] References Cited

U.S. PATENT DOCUMENTS 3,325,677 6/1967 Orr ..... 315/5.38 X
3,369,191 2/1968 Schram et al. ..... 315/5.38 X
4,000,471 12/1976 Pankow ..... 330/43 X
4,398,122 8/1983 Gosset ..... 315/5.38
4,638,215 1/1987 Schmid et al. ..... 315/3.5
5,103,187 4/1992 Durand et al. ..... 315/3.5 X

FOREIGN PATENT DOCUMENTS 253542 10/1990 Japan ..... 315/3.5

OTHER PUBLICATIONS

Momota et al: "Development of 22–GHz Band High–Power TWT for Direct Broadcasting Satellites" Proceedings of the Eighteenth International Symposium on Space Technology and Science –Kagoshima 1992.

*Primary Examiner*—Benny T. Lee
*Attorney, Agent, or Firm*—Cushman Darby & Cushman, L.L.P.

[57] ABSTRACT

According to this invention, a traveling-wave tube amplifier includes a traveling-wave tube having a multistage depressed collector and a power supply for applying operation voltages to the traveling-wave tube. A body voltage (Vb) for a cathode of the traveling-wave tube is set to be lower than a small-signal synchronous voltage (Vbs) at which a small-signal gain of the traveling-wave tube is maximized. As a result, a tube efficiency (ηt) of the traveling-wave tube can be increased and an efficiency of the traveling-wave tube amplifier can be increased as compared with a conventional device.

3 Claims, 2 Drawing Sheets

TRAVELING-WAVE TUBE AMPLIFIER HAVING COLLECTOR POTENTIAL LOWER THAN BODY POTENTIAL

BACKGROUND OF THE INVENTION

1. Field of the Invention

The present invention relates to a traveling-wave tube amplifier (TWTA) and, more particularly, to a traveling-wave tube amplifier in which the collector potential of a traveling-wave tube is set to be lower than a body potential of the traveling-wave tube potential so as to operate the traveling-wave tube amplifier.

2. Description of the Related Art

In a traveling-wave tube amplifier using a traveling-wave tube having a depressed collector, a voltage applied across the cathode and interaction circuit of the traveling-wave tube, i.e., a body voltage Vb, is generally set to be equal to a small-signal synchronous voltage Vbs, i.e., a body voltage at which a small-signal gain is maximized at an operating frequency when a cathode current is kept constant. Depending on conditions, the body voltage Vb is set to be slightly higher than the small-signal synchronous voltage Vbs or equal to a voltage Vbe at which an electronic efficiency $\eta e$ of the traveling-wave tube is maximized, or is set to be an intermediate voltage between the small-signal synchronous voltage Vbs and the voltage Vbe, or more.

In this case, the electronic efficiency $\eta e$ is a conversion efficiency from a kinetic energy of an electron beam to a radio frequency wave energy and defined by the following equation:

$$\eta e = Po/(Vb \times Ik)$$

where Po is a saturation RF output power, Vb is a body voltage, and Ik is a cathode current. Note that a small signal means that a RF output power is negligibly small with respect to an electron beam power (Vb×Ik).

When the body voltage Vb is set to be equal to the small-signal synchronous voltage Vbs, a high gain can be obtained. When the body voltage Vb is set to be equal to the voltage Vbe at which the electronic efficiency $\eta e$ is maximized or to be slightly higher than the voltage Vbe, the cathode current can be minimized, and the long operating life can be obtained.

The body voltage Vb of a conventional traveling-wave tube is defined from the above point of view. It is generally understood that the efficiency of the traveling-wave tube amplifier is determined by, except for the efficiency of a power supply and the transmission loss between the output portion of the TWT and the output portion of the TWTA, a tube efficiency $\eta t$ of the traveling-wave tube, i.e., a ratio of the RF output power of the traveling-wave tube to the total power consumption thereof. It is desired that the tube efficiency $\eta t$ of the traveling-wave tube is increased by any method so as to increase the efficiency of the traveling-wave amplifier.

SUMMARY OF THE INVENTION

It is an object of the present invention to provide a traveling-wave tube amplifier (TWTA) capable of increasing a tube efficiency $\eta t$ of a traveling-wave tube as compared with a conventional device, so as to increase the efficiency of the TWTA itself.

In a conventional traveling-wave tube amplifier, a body voltage Vb is set to increase an amplification gain or prolong the service life. The present inventors found that the total efficiency of the traveling-wave tube amplifier was not necessarily optimized when the 10 traveling-wave tube was operated at a body voltage Vb determined by the conventional method. From this point of view, according to the present invention, there is provided a traveling-wave tube amplifier comprising a traveling-wave tube having a depressed collector with a plurality of collector electrodes, which is generally called a "multi-stage depressed collector", and a power supply for applying an operating voltage to the traveling-wave tube, wherein a body voltage for a cathode of the traveling-wave tube is set to be lower than a small-signal synchronous voltage at which a small-signal gain of the traveling-wave tube is maximized.

In the traveling-wave tube amplifier according to the present invention, the tube efficiency of the traveling-wave tube can be increased as compared with a conventional device, and, therefore, a highly efficient operation of the overall traveling-wave tube amplifier can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
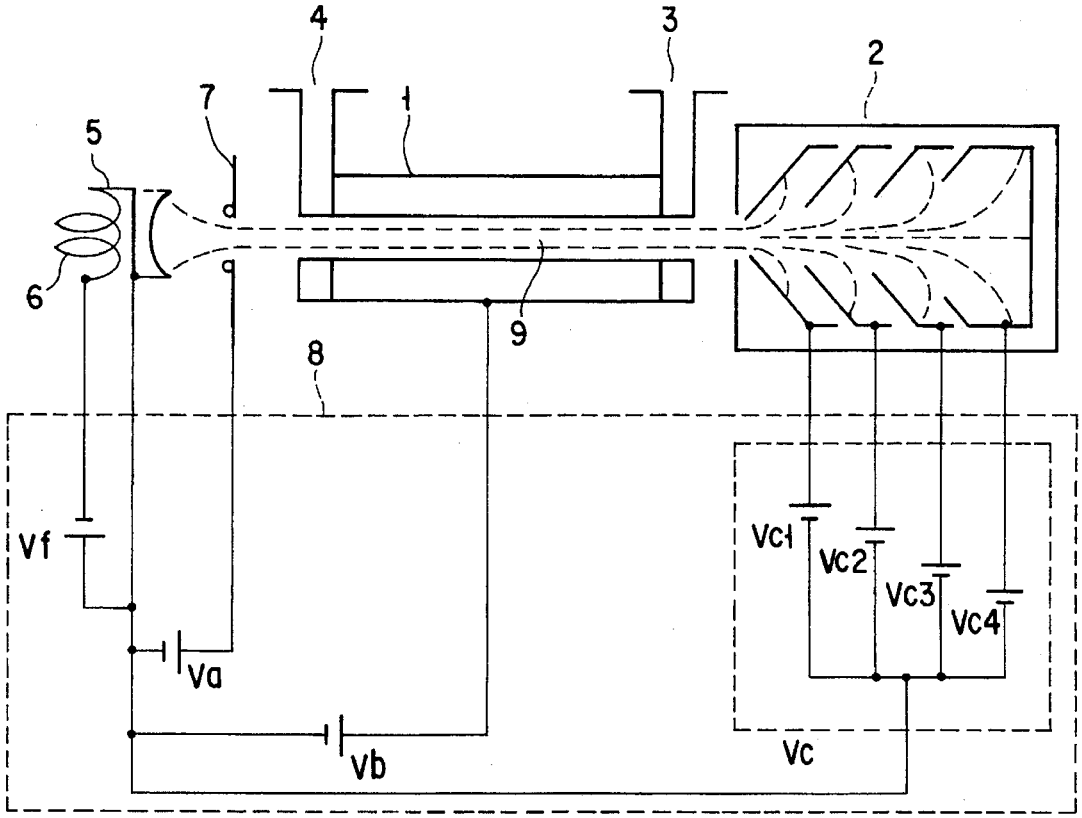
FIG. 1 is a schematic view showing the arrangement of a traveling-wave tube amplifier according to an embodiment of the present invention.

The entire arrangement of a traveling-wave tube amplifier according to the present invention is shown in FIG. 1. Referring to FIG. 1, reference numeral 1 denotes a interaction circuit, constituted by a coupled-cavity type slow-wave circuit for slowing a transmitted RF wave, for causing the RF wave to interact with the electron beam; reference numeral 2, a collector incorporating a plurality of collector electrodes for collecting electrons; reference numeral 3, a RF output portion for outputting an amplified RF wave; reference numeral 4, a RF input portion for receiving a RF wave; reference numeral 5, a cathode for emitting electrons; reference numeral 6, a heater for heating the cathode reference numeral 5; reference numeral 7, an anode for accelerating and concentrating the electrons from the cathode; reference numeral 8, a power supply circuit; and reference numeral 9, an electron beam.

Reference symbol Vf denotes a heater power supply; reference symbol Va, an anode power supply for applying a beam acceleration voltage across the cathode and the anode;

reference symbol Vb, a body voltage power supply for applying an acceleration voltage across the cathode and the interaction circuit; and reference symbol Vc, a collector power supply for applying a voltage to each electrode of the collector. In this case, collector voltages Vc1, Vc2, Vc3, Vc4 for the cathode are set to be lower than the body voltage Vb for the cathode and the collector voltages Vc1 to Vc4 are set to have a relation Vc1>Vc2>Vc3>Vc4. Note that voltages represent values with respect to the cathode potential hereinafter, unless otherwise specified.

Figure 2A:
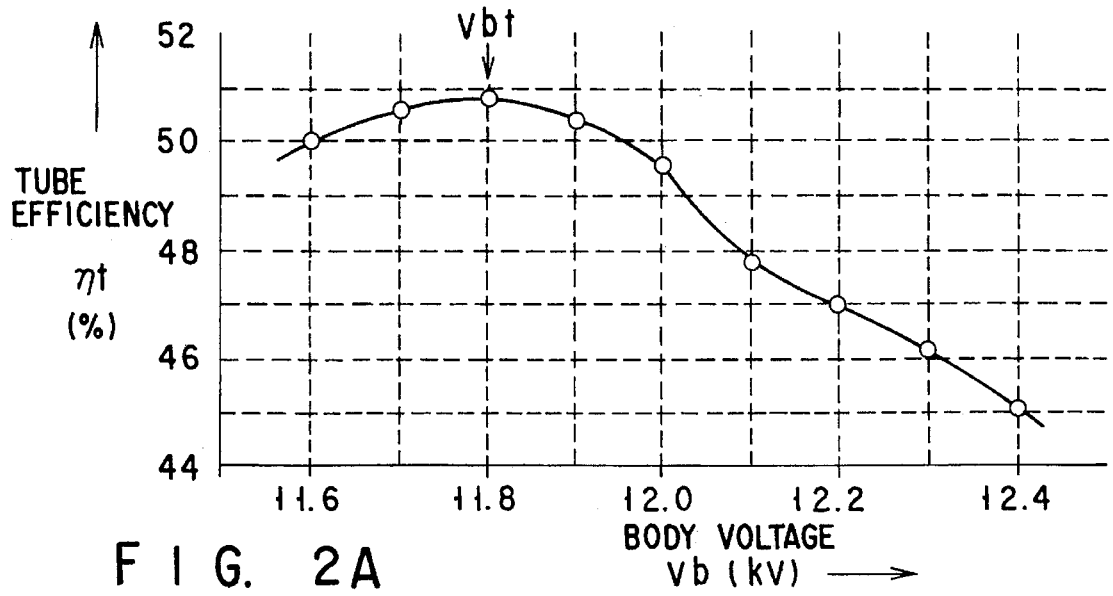
FIGS. 2A, 2B, and 2C are graphs for explaining an effect of the traveling-wave tube amplifier shown in FIG. 1.
Figure 2B:
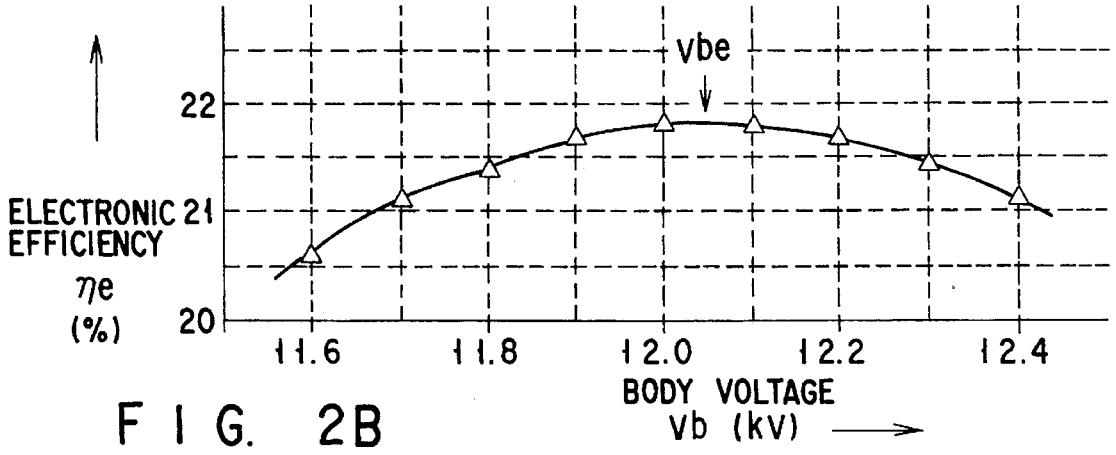
Figure 2C:
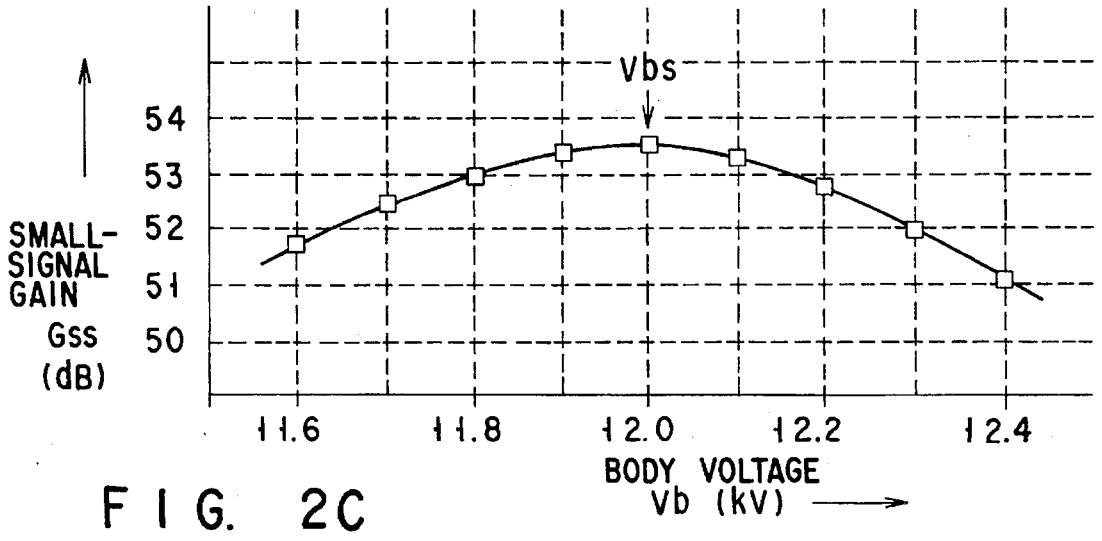

In the embodiment of the traveling-wave tube amplifier according to the present invention, the collector voltages are set to be lower than the body voltage to operate the traveling-wave tube amplifier, and the body voltage is set to be lower than a small-signal synchronous voltage at which the small-signal gain of the traveling-wave tube is maximized to operate the traveling-wave tube amplifier. When the operation voltages are set as described above, characteristics shown in FIGS. 2A, 2B, and 2C can be obtained. FIGS. 2A, 2B, and 2C show a variation in tube efficiency ηt versus the body voltage Vb (Vbt being the body voltage at which ηe is maximized), a variation in electronic efficiency ηe, and a variation in small-signal gain Gss of the traveling-wave tube having a four-stage depressed collector type versus the body voltage Vb (Vbs being the body voltage at which Gss is maximized), respectively. In this case, a RF output saturated power Po of the traveling-wave tube is kept constant at each value of the body voltage by adjusting the anode voltage.

As is apparent from FIG. 2B, a body voltage Vbe at which an electronic efficiency ηe of the traveling-wave tube is maximized is 12.05 kV. As shown in FIG. 2C, a body voltage Vb at which the small-signal gain of the traveling-wave tube is maximized at a small signal synchronous voltage Vbs of 12.0 kV, and this voltage is slightly lower than the voltage Vbe. In contrast to this, as is apparent from FIG. 2A, when the body voltage Vb is lower than the voltages Vbs and Vbe, i.e., 11.8 kV, the tube efficiency ηt is maximized. Therefore, when the body voltage is set to be a voltage Vbt at which the tube efficiency can be maximized, the efficiency of the overall traveling-wave tube amplifier can be increased higher than that of a conventional device by about 1% or more. This increase in efficiency is close to a value obtained by increasing the number of collector electrodes of the depressed collector from 4 to 5. Note that, even if the number of collector electrodes is increased by one, the number of parts, size, weight of TWT, and the number of collector power supply are increased. For this reason, an increase in the number of collector electrodes must be avoided in a traveling-wave tube amplifier installed in a satellite. Therefore, the effectiveness of the present invention is apparent.

Figure 3:
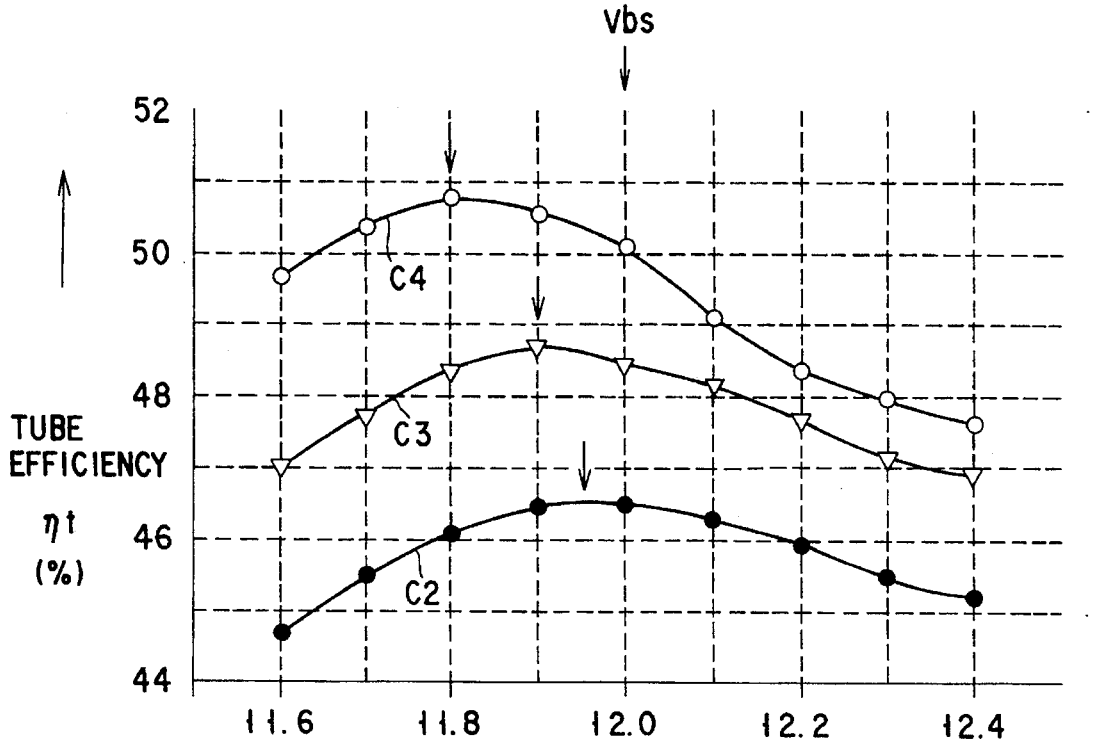
FIG. 3 is a graph for explaining an effect of a traveling-wave tube amplifier according to the present invention.

FIG. 3 shows a variation in tube efficiency ηt for the body voltage Vb when the number of collector electrodes incorporated in the depressed collector is changed. A curve C2 in FIG. 3 is obtained when a two-stage depressed collector is used, a curve C3 is obtained when a three-stage depressed collector is used, and a curve C4 is obtained when a four-stage depressed collector is used. Note that the ratio of voltages applied to the collector electrodes is an integral ratio in consideration of simplifying the collector power supply and Vc1 is adjusted at an optimal voltage at which the maximum efficiency can be obtained at each body voltage Vb. That is, in a case of using a two-stage depressed collector (C2), when a voltage applied to the first collector electrode which is closest to the interaction circuit is set to be Vc1, and a voltage applied to the second collector electrode next to the first collector electrode is set to be a ratio of voltages Vc2, Vc1:Vc2=2:1 is satisfied. Similarly, in a case of using a three-stage depressed collector (C3), a ratio of voltages applied to the first, second, and third collector electrode is set to Vc1 : Vc2 : Vc3=3 : 2 : 1. In addition, in a case of using a four-stage depressed collector (C4), a ratio of voltages applied to the first, second, third, and fourth collector electrodes is set to Vc1 : Vc2: Vc3: Vc4=5 : 4 : 2 : 1. This case almost corresponds to the characteristics shown in FIG. 2A.

As is apparent from FIG. 3, in the case using a two-stage depressed collector (C2), the body voltage was slightly lower, i.e., about 11.95 kV, than the small-signal synchronous voltage Vbs (12.0 kV) at which the small-signal gain was maximized, and the tube efficiency ηt became maximum (46.6%). In the case using a three-stage depressed collector (C3), when the body voltage was lower, i.e., about 11.9 kV, than the small-signal synchronous voltage Vbs by 0.1 kV, the tube efficiency ηt became maximum (48.7%). In addition, in the case using a four-stage depressed collector (C4), when the body voltage was further lower, i.e., about 11.8 kV, than the small-signal synchronous voltage Vbs, the tube efficiency ηt became maximum (50.8%). More specifically, in the case using the four-stage depressed collector (C4), the body voltage Vb for the cathode was set to be 11.8 kV, the voltage, of the first collector electrode which was closest to the interaction circuit, for the cathode was set to be 6.8 kV optimal for efficiency, the voltage of the second collector electrode on the downstream side of the first collector electrode was set to be 5.44 kV, the voltage of the third collector electrode was set to be 2.72 kV, and the fourth collector electrode on the final stage was set to be 1.36 kV. In this case, the maximum efficiency can be obtained.

As described above, the following fact is confirmed. That is, when two or more collector electrodes are incorporated, and the body voltage is set to be lower than the small-signal synchronous voltage Vbs at which the small-signal gain of the traveling-wave tube is maximized, the tube efficiency can be increased. More specifically, when three or more collector electrodes are incorporated, the body voltage is set to be a voltage lower than 99.5% (11.95 kV in the above example) of the small-signal sync voltage Vbs, so as to operate the traveling-wave tube amplifier. This operation is more preferable to obtain high efficiency.

A helix type slow-wave circuit can be used as the interaction circuit of the traveling-wave tube. In addition, when a velocity-tapered slow-wave circuit in which a phase velocity is gradually increased or decreased in the middle of the slow-wave circuit or in a region near an output portion is used as the interaction circuit of the traveling-wave tube, the above effect can be more reliably obtained.

As has been described above, according to the present invention, the tube efficiency of the traveling-wave tube, and, therefore, the efficiency of the overall traveling-wave tube amplifier can be reliably increased as compared with a conventional device.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A travelling-wave tube amplifier comprising:

a traveling-wave tube including:

an electron gun assembly having a cathode for discharging electrons as an electron beam, an interaction circuit operatively connected to said electron gun assembly, said interaction circuit having a slow-wave circuit, for transmitting a RF wave applied to the slow-wave circuit and for causing the RF wave to interact with the electron beam produced by the electron gun assembly, and a plurality of collector electrodes operatively connected to said interaction circuit for collecting electrons in the electron beam interacted with by said interaction circuit; and a power supply connected to said travelling-wave tube for applying separate operational voltages to each of said cathode, said interaction circuit, and said plurality of collector electrodes of said traveling-wave tube, wherein the voltage of said collector electrodes is set to be lower than the voltage of said interaction circuit, and the voltage for said cathode is set to be lower than a small-signal synchronous voltage at which a small-signal gain of said traveling wave tube is maximized, and wherein said traveling-wave tube comprises at least three collector electrodes, and the voltage for said cathode is not more than 99.5% of the small-signal synchronous voltage.

2. The travelling-wave tube amplifier of claim 1 wherein the number of collector electrodes is one of 3 and 4 electrodes.

3. The travelling-wave tube amplifier of claim 1 wherein voltages applied to the respective collector electrodes gradually decrease in a direction of electron beam travel.

* * * * *